United States Patent [19]

McGouran, Jr.

[11] Patent Number: 4,911,326

[45] Date of Patent: Mar. 27, 1990

[54] CONTAINMENT SYSTEM

[76] Inventor: Frances J. McGouran, Jr., 14151 Montfort No. 363, Dallas, Tex. 75240

[21] Appl. No.: 231,202

[22] Filed: Aug. 11, 1988

[51] Int. Cl.[4] ..... B65D 88/76

[52] U.S. Cl. ..... 220/445; 220/1 B; 220/18; 220/85 S

[58] Field of Search ..... 141/83; 220/1 B, 5 A, 220/85 S, 445, 446, 447, 18

[56] References Cited

U.S. PATENT DOCUMENTS

| | | | |
|---|---|---|---|
| 3,692,206 | 9/1972 | Hornbeck | 220/445 |
| 3,848,765 | 11/1974 | Durkop . | |
| 3,995,472 | 12/1976 | Murray . | |
| 4,373,058 | 2/1983 | Horton . | |
| 4,391,946 | 7/1983 | Akerberg et al. . | |
| 4,439,348 | 3/1984 | Akerberg . | |
| 4,561,292 | 12/1985 | Pugnale et al. . | |
| 4,568,925 | 2/1986 | Butts . | |
| 4,602,250 | 7/1986 | Peace . | |
| 4,607,522 | 8/1986 | Sharp . | |
| 4,625,892 | 12/1986 | Carlin, Jr. . | |
| 4,638,920 | 1/1987 | Goodhues, Jr. | 220/85 S |
| 4,673,926 | 6/1987 | Gorman . | |
| 4,685,327 | 8/1987 | Sharp . | |
| 4,708,015 | 11/1987 | Sharp . | |
| 4,796,676 | 1/1989 | Hendershot et al. | 141/83 |

FOREIGN PATENT DOCUMENTS

| | | | |
|---|---|---|---|
| 0228717 | 8/1963 | Austria | 220/1 B |
| 0458205 | 7/1949 | Canada | 220/1 B |
| 2803210 | 7/1979 | Fed. Rep. of Germany | 220/445 |
| 0286700 | 12/1986 | Japan | 220/1 B |
| 0380903 | 9/1932 | United Kingdom | 220/445 |

OTHER PUBLICATIONS

QO Chemicals, Inc., "Corrosion Resistant Furan Polymer Concrete Made with QO FA-Rok Resin/Catalyst System", Bulletin 450-A.

Ashland Chemicals, "Guide to the Selection and Application of Hetron and Aropol, Polyester, Vinyl Ester, and Furan Resin Laminates for use in Corrosion Control Applications", 1980 Edition.

*Primary Examiner*—Jimmy G. Foster

*Attorney, Agent, or Firm*—Richards, Medlock & Andrews

[57] ABSTRACT

A containment system useful for storing gases and liquid being comprised of a primary storage container enclosed by a secondary containment vessel having a removable panel dimensioned such that the primary storage container may be installed and removed as desired, the system further provided with leak detection means in communcation with the interior of the secondary containment vessel. The system results in a storage facility which minimizes possible contamination of the environment by leakage of the stored fluid, and provides safe convenient access to the storage container and leak detectors for maintenance and repairs.

9 Claims, 3 Drawing Sheets

CONTAINMENT SYSTEM

TECHNICAL FIELD

The invention relates to liquid and/or gas storage and containment systems. More particularly, the invention relates to a containment system having a primary storage container, within a secondary leak containment vessel having leak detectors provided to signal leakage from the primary storage container.

BACKGROUND OF THE INVENTION

Throughout the world, various liquids and gases are stored in bulk amounts in storage tanks or containers. Many of the liquids or gases are dangerous because they are flammable, poisonous, corrosive, and/or carcinogenic. Many of these storage tanks are installed underground and are subject to naturally occurring corrosive agents and shifting ground. In the past, many of the underground tanks became damaged by virtue of corrosion, shifting ground, inadvertent drilling or puncturing from nearby construction. Of course, a damaged tank can leak pollutants into the environment. Above ground storage tanks may also develop leaks; however, leaks in underground storage tanks are difficult to detect. Initially, these leaks can occur slowly and go undetected for many years. Even if detected, in the past many owners of underground tanks did not repair the tanks if the leaks were small relative to repair costs.

A majority of the underground storage tanks are used for the storage of gasoline at retail stations. Most of these retail gas stations are located in highly populated areas and thus the health hazard is obvious. Typically, underground storage tanks are constructed of metal or fiberglass reinforced resinous materials. Historically, these underground tanks were not installed with outer containment tanks. Therefore, many of the older tanks (especially steel tanks) are or may become damaged and leak pollutants into the environment.

Due to the potential public health hazards described above, new federal regulations and local ordinances have been enacted or are presently being proposed to require the owners of underground storage tanks to repair and/or replace damaged tanks which leak. The regulatory movement is also directed at requiring that more leak resistance storage tanks be initially installed.

The approach adopted by most manufacturers to improve the containment of liquids in underground storage involve the use of a double wall constructed storage tank. For example, such tanks are disclosed in U.S. Pat. Nos. 4,708,015; 4,685,327; 3,848,765; and 4,568,925. Some of these storage vessels, as disclosed in the patents, also have a leak detecting system of some type. The difficulty with the double wall construction is that the fabrication is complicated, care must taken in fabricating the outer tank such that the inner tank is not damaged. Many have a fiberglass outer shell which can be cracked or punctured in shipment. If the flaw is not detected prior to installation the outer shell will not serve any containment function. In these vessels, if a leak does occur and is detected, the only solution is to dig up the tank and replace the assembly in toto, or attempt to repair the inner vessel from the inside. Such repairs require draining the tank, assuring that it is safe enough for workmen to enter, and creates difficulties in being able to assure that repairs to the inside tank do not damage the outer tank. Furthermore, these double tanks are fairly rigid, and in areas of the country where earthquakes are a potential hazard, the tank may be fractured as a result of pressure exerted by an earthquake. Thus, there is a need to provide an economical, easily manufactured, versatile and reliable containment system for storage of material and, in particular the underground storage of materials.

The present invention provides for a containment system which provides for an outer containment vessel which is inexpensive to construct, easily assembled, utilizes conventional single walled storage containers such as tanks or drums, and provides for easy repair and replacement of the storage container without damage to the outer containment vessel.

SUMMARY OF THE INVENTION

The present invention provides a liquid/gas containment system. The new system comprises at least one primary storage container for the storage of liquid or gas (fluids) provided with the necessary plumbing for the intended use, such as a fill pipe, dispensing line and vent, the storage container is confined within a secondary containment vessel, and a detection means located within the space between the containment vessel and storage container(s) for detecting leakage.

The secondary containment vessel is constructed of polymer concrete and has a removable panel of sufficient dimensions to allow installation, removal and replacement of the storage container(s). Preferably, the secondary containment vessel has supporting members upon which the storage container(s) rest such that there is a free space between the bottom of the storage container(s) and the bottom of the containment vessel. Leak detection sensors are mounted within the containment vessel and are in communication with an alarm outside of the containment vessel.

DETAILED DESCRIPTION

Figure 1:
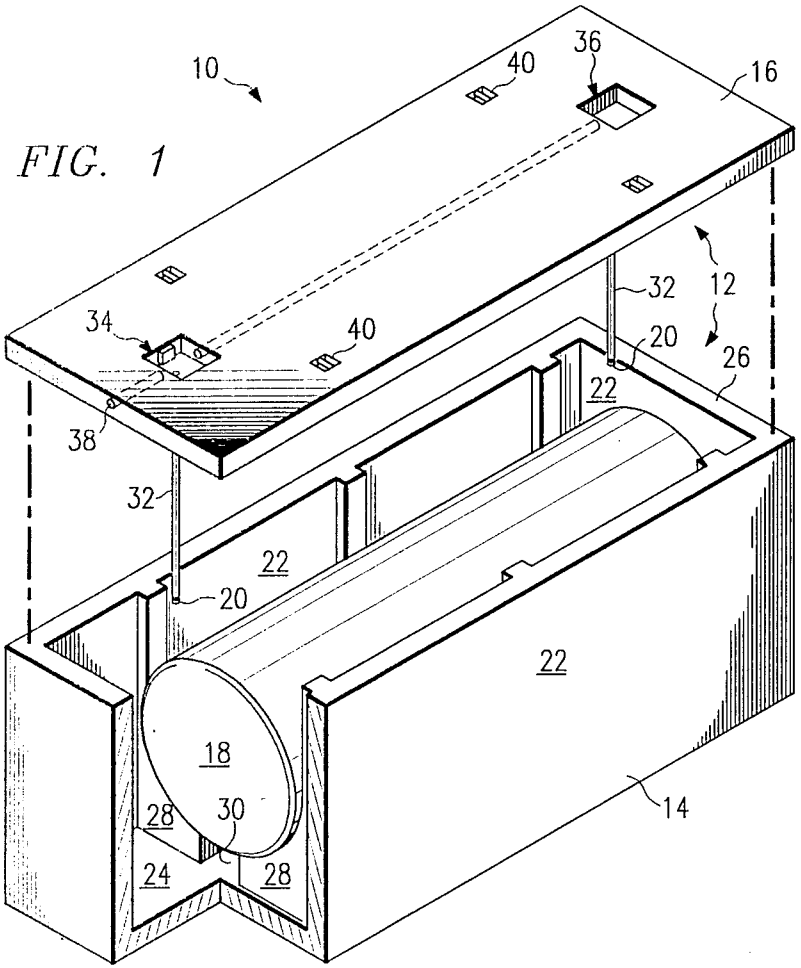
FIG. 1 is a sectional perspective view of an embodiment of the containment system of the present invention.

FIG. 1 illustrates the liquid and/or gas storage containment system 10 comprising an outer containment vessel 12 constructed of based section 14, and removable panel 16; an inner primary storage container 18, and leak detectors 20 for sensing leakage of gases and/or liquids from the storage container 18. The containment vessel 12 composed of a base 14 having four sidewalls 22 extending upwardly from a bottom wall 24 and a removable wall panel 16 which mates with top 26 of the sidewalls 22.

One or more supporting members 28 are provided to support the storage container 18 within containment vessel 12. The supporting members 28 preferably create an open space 30 between storage container 18 and containment vessel 12 at the lower part of storage container 18. At least one leak detector sensor 20 is positioned in the space between the storage container and containment vessel. Preferably, it is positioned such that the sensor 20 is in close proximity to the bottom wall 24 of containment vessel 12.

In the preferred embodiment illustrated in FIG. 1, sensor 20 supported on conduit 32 extends downwardly, from removable wall panel 16 which forms the top of containment vessel 12. Recesses 34 are provided in removable panel 16 to house the sensor control box (not shown in FIG. 1) and a recess cover 36 is provided. Passageways 38 provide conduits for wiring the sensors in communication with the exterior of containment vessel 12. Suitable lifting eyes 40 can be provided to facilitate placement and removal of the removable panel.

Figure 4:
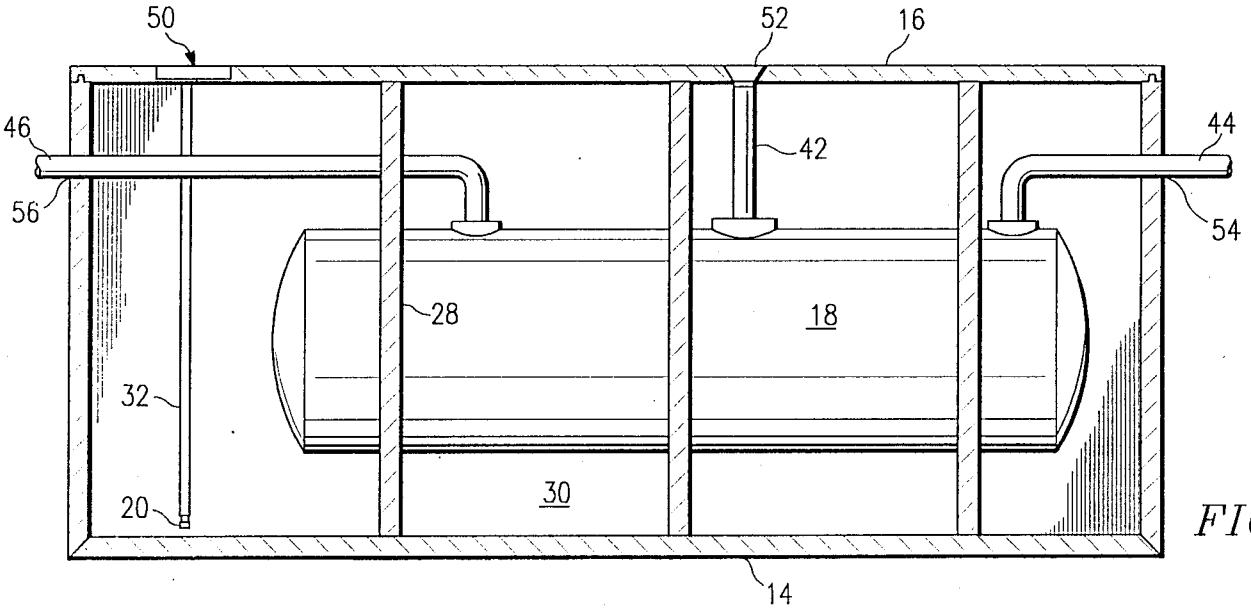
FIG. 4 is a cross-sectional view of an embodiment of the containment system of the present invention with appropriate plumbing.

FIG. 4 illustrates the storage container equipped with appropriate plumbing to provide a pipe 42 through which to fill the storage container 18 with fluid, a vent 44 to vent the container 18 to prevent formation of a vacuum in the container, and a outlet conduit 46 which may be connected to a pump and various valves to control removal of fluid from the container. These pipes pass through openings 52, 54 and 56 in the containment vessel. Suitable openings are provided in any desired location in the containment vessel, such as in the removable panel or in the sidewalls.

The containment system of the present invention does not require an outlet or vent apparatus. For example, where the system is used to contain toxic waste, it may be unnecessary and undesirable to have any outlet means but only an opening by which the storage container may be filled. Also, the containment system is particularly suited to the storage of a multiplicity of drums such as 55 gallon drums of waste.

The containment system of the present invention may be used for either aboveground or underground storage. The containment system is particularly adapted to underground storage and will be discussed in reference to the storage of gasoline which is envisioned to be the most common use of the system. However, the system may also be utilized for the storage of other chemicals, toxic waste, and gases, either above or below ground. For example, the containment system invention of the present application is suitable for the storage of alkanes, alkenes, alkynes, arenes, haloalkanes, alcohols, ethers, amines, aldehydes, ketones, carboxylic acids, esters, and amides. Specifically, the containment system of the present application is suitable for the storage of acetone, butyl alcohol, cyclohexane, benzene, hexane, naptha, propylamine, styrene, tetrahydrofuran, and toluene. The containment system of the present invention is also suitable for the storage of ammonia, arsenic fluorides, boron fluorides, chlorine, fluorine, molybdenum hexafluoride, silane, silicon clorides and tungsten hexafluoride. The above list is included merely to give examples of the varieties of liquids and/or gases which can be contained by the present invention. The above list is not meant to be exclusive and/or limit the scope of the present invention.

In operation, containment system 10 provides a containment vessel 12 in which is placed primary storage container 18. With appropriate plumbing, valves and pumps, the storage container is filled with fluid such as gasoline to be stored until it is desired to be dispensed. (See FIG. 4.) The stored fluid may then be removed in predetermined amounts through appropriate pipes, valves and pumps. In a preferred embodiment, storage container 18 rests on one or more support members 28 which prevent contact of the storage container 18 with containment vessel 12 other than at the mating points with support members 18. This provides a free space between the outer wall of the storage container and the inner walls of the containment vessel. This space allows for appropriate plumbing to be connected with the storage container, and provides an area in which leak detectors 20 can be inserted between the outer wall of storage container 18 and the inside of containment vessel 12. In the event that a leak develops in storage container 18, fluid will leak into containment vessel 12 whereupon the fluid or vapors will cause the leak detector to signal an alarm indicating a leak has occurred. Thereafter, the containment vessel may be cleaned and the storage container repaired or replaced.

Figure 3:
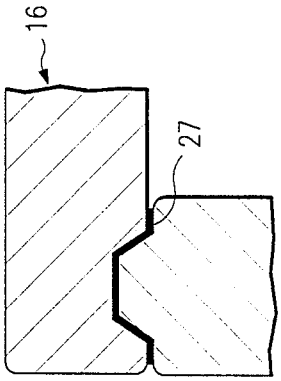
FIG. 3 is a cross-sectional view of the joint between the removable panel and the base of the containment vessel.

The base of the containment vessel preferably is formed of a bottom wall with upwardly extending sidewalls. FIG. 3 illustrates a partial cross-sectional view of a sidewall 22 and removable wall panel 16. This box-like construction is preferred for several reasons. First, in a preferred embodiment, the four sidewalls and bottom wall are molded together as a single unit dimensioned such that it is transportable on a truck. At the use location, a hole is dug and the containment vessel base 14 is lowered into the hole such that the top edges 26 of the sidewalls 22 are in close proximity with the surface of the ground. The hole can then be back filled around the outside of walls 22 of the base 14 portion of the containment vessel. Thereafter, storage container 18 is lowered into the containment vessel and appropriate plumbing connections are made. In this manner, containment vessel base 14 is used as shoring and allows workmen to make necessary connections to storage container 18 without requiring shoring of the ground around the work area which is required when installing the conventional storage tanks in the ground. The removable wall panel 16 of the containment vessel is then set upon the top portion of the sidewalls of the base of the containment vessel. Preferably there is a seal 27 or gasket between the removable wall panel and the base to provide a substantially fluid/air-tight seal. As shown in FIG. 3, a positioning groove 58 and mating ridge 60 are provided to hold the removable wall panel in place. Openings in the containment vessel are provided for insertion of sensors into the interior of the containment vessel and also for suitable plumbing. These openings are also sealed with appropriate gaskets to prevent leakage of fumes from the containment vessel.

Figure 2:
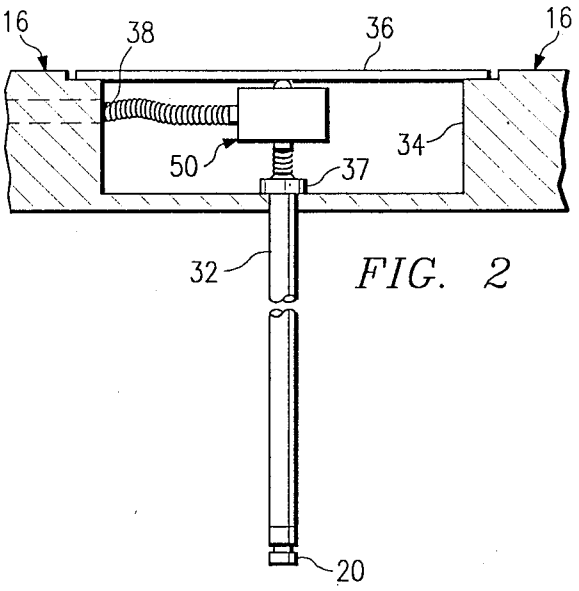
FIG. 2 is a cross-sectional view of the removable panel of FIG. 1 in the area of leak detection unit.

Removable wall panel 16 can be adapted to house leak detection hardware. FIG. 2 is a partial cross-sectional of removable wall panel 16 in the area of recesses 34. Recesses 34 accommodate portions of the leak detecting system such as control box 50. Preferably, the equipment is provided with access lids 36 to enable convenient removal and maintenance of the control box 50 and sensors 20. The sensors 20 are removable and placed by suspending them on conduit 32 which can be connected to the wall panel by threaded connector 37. A gasket 39 may be provided to seal the vessel. Wiring 38 communicates the control box and sensor with a signal or alarm outside of the vessel. The leak detection system can be mounted at other locations on the vessel.

The leak detector sensors are suspended from the underside of panel 16 positioned beneath the lids. The leak detector sensors are easily removed from the storage system by unscrewing connector 37. The leak detectors are extended down to the bottom of the outer containment vessel through the use of a pipe, a cable or any other suitable means which extends the leak detectors to the bottom of the containment vessel. The lowering device should be capable of retrieving the leak detectors. The leak detecting sensors are preferably placed within 3 inches of the bottom of the containment vessel to provide for rapid detection. Leak detectors 20 are in electronic communication with each other which is in communication with outside monitoring mechanisms.

The leak detector may be of any suitable type known in the art. The sensor for the system is selected based upon the fluid stored in the storage tank. A model SC100 Smart Sensor made by General Monitors Corporation of California is an example of a leak detector which can be used in the present invention and is suitable to monitor gasoline leaks.

In operation of the device, if a leak develops, the leak will trigger the sensors, and the control box will activate the alarm. The leak will be contained by the containment vessel thus preventing contamination of the environment. Once the alarm goes off, appropriate corrective action may be taken. Such action would include an inspection of the storage container. Preferably, the removable panel of the containment vessel will be removed completely, rather than having a manhole access. The reason for this is to enhance safety.

Outer containment vessel 12 can be of prefabricated polymer concrete sidewalls, and bottom wall sections which are bonded together at the use site, the vessel can have a prefabricated base with prefabricated removable wall panel. Preferably, the sidewalls and bottom wall are cast in a single piece to enhance integrity. The sidewalls and bottom wall may be precast and then delivered to the use site and bonded together. It is possible to cast the polymer concrete at the use site. However, this is least desired as it requires construction of forms and is generally less economical than precasting. The vessel is constructed of polymer concrete, also known as synthetic resin concrete or plastic resin concrete. Polymer concrete displays impressive resistance to corrosion, water absorption, abrasion and frost. Further, polymer concrete can be molded and is much stronger than conventional concrete. Additionally, the resin utilized to make the concrete can be varied such that the resin most resistent to the chemical being stored can be utilized. For example, furan resins are particularly useful when the fluid being contained is gasoline, acid or corrosive. Epoxy resins are useful in containing detergent compositions.

Polymer concrete has three primary components: a resin binder, a catalyst and a filler. The properties of polymer concrete are determined primarily by the synthetic resin used as a binder. Suitable resins for the practice of this invention include, but are not limited to, the following: unsaturated polyester resin, epoxy resin, polystyrene resin, polymethyl resins, methylcrylate resins and furan resins.

The second component of polymer concrete is the filler. The fillers can be any suitable filler to give the desired strength. The filler material should have a hardness as measured by the revised MOH hardness scale above 5.0 and preferably above 7.0 MOHs. Any filler of the desired hardness may be used and the preferred filler is granite. MOHs scale values for various materials are:

| Revised MOHs Scale Hardness Value | Material |
|---|---|
| 1. | Talc |
| 2. | Gypsum |
| 3. | Calcite |
| 4. | Fluorite |
| 5. | Apatite |
| 6. | Orthoclase |
| 7. | Vitreous pure silicon |
| 8. | Quartz, granite |
| 9. | Topaz |
| 10. | Garnet |
| 11. | Fused zirconium oxide |
| 12. | Fused aluminum |
| 13. | Silicon carbide |
| 14. | Boron carbide |
| 15. | Diamond |

The granular size of the filler used can vary in accordance with the size of the vessel to be manufactured. To give a reasonable curing time and to assure that the resin completely reacts, the moisture content of the filler should be 0.5% or less or be dried to such a moisture content. Preferably the filler is a mixture of coarse, intermediate and fine aggregates. The monomers useful in production of polymer concrete include styrene, diallyl, phthalate, vinyl toluene, acrylic and furfuryl alcohol. Preferably, the resin is of a higher reactivity. A catalyst is employed to initiate and promote polymerization cross-linking and curing. Suitable catalysts include chloride salts such as zinc chloride, calcium chloride, cupric chloride or combinations thereof. An accelerator may be employed to assist in the curing. The accelerator is usually either a metallic soap or a tertiary amine. Suitable accelerators include but are not limited to diethyl aniline, dimethyl aniline and dimethyl paratoluene and 12% cobalt solution.

The polymer concrete can be made by drying the aggregate, spraying catalyst on the aggregate, and then mixing the aggregate and resin together and pouring the mixture into a mold. The reaction of the resin is exothermic. The aggregate serves as a heat sink for the heat generated by the reaction. Additional cooling may be applied to the mold. However, it is desirable that the amount of aggregate utilized be sufficient to dissipate the heat of the reaction.

The polymer concrete is typically comprised of from 78 to 93% by weight aggregate, 7 to 19% by weight resin and from 0.3 to 3% by weight catalyst. The catalyst should be employed in amounts of approximately 1% to 15% by weight based on the weight of the resin utilized. Preferably about 8 to 12% catalyst by weight based on the weight of resin utilized. Suitable resin for the polymer concrete is sold under the trademark QO FA-ROK by QO Chemicals, Inc., West Lafayette, Ind.

The aggregates utilized is preferably a mix of coarse, intermediate and fine. The preferred compositions of the aggregate, are 40–60% of coarse particles by weight of the total aggregate mix, 15–25% of intermediate size aggregate based on the total weight of the aggregate mix and 25–35% by weight of fine. The largest coarse aggregate particles should have a diameter less than about ¼ of the wall thickness being molded.

In producing the polymer concrete it is desirable that it be adequately compressed to give the desired final properties. Preferably, this is accomplished by a continuously pouring process of each molded unit.

After the polymer concrete is mixed, it is ready to be molded. Suitable materials to be used in making the molds include, but are not limited to, the following: wood, steel, stainless steel, aluminum, glass reinforced fibers, plastic, silicone, polyethylene, and tetrafluorethylene, known as Teflon. For mass production, steel and aluminum are the preferred materials because these materials have a longer life. Suitable release agents, which allow the removal of the sections from the molds, include, but are not limited to the following: silicone, grease, oil and emulsions. Reinforcing elements such as fiberglass rods may be incorporated into the mold if desired.

To ensure that the molded sections of polymer concrete have the desired final properties, the molding is preferably done at a manufacturing location where the molding process can be controlled and not interrupted.

To provide adequate compression of the polymer concrete, it is preferred that the section being molded be subjected to vibration. This can be achieved through the use of vibrating rods. Preferably, the polymer concrete sections are cured by heating them to a temperature in the range of 40° F. to 400° F. The temperature can vary according to the resin utilized but preferably the cure temperature will be above 70° F. and below 200° F.

Polymer concrete is much superior to typical portland cement concrete. The superior strength characteristics of polymer concrete allow the removable panel to be used as part of the road surface at a gas station. The removable panel will be sturdy enough to support traffic yet light enough to be removed with relative ease. The comparison of typical properties of polymer concrete versus portland cement are shown in the table below.

TABLE 1

TYPICAL PROPERTIES OF PORTLAND VS. POLYMER CONCRETE

| PROPERTY | PORTLAND CEMENT CONCRETE | POLYMER CONCRETE |
|---|---|---|
| Compressive Strength, psi | 5,000 | 19,000 |
| Tensile Strength, psi | 350 | 1,400 |
| Modulus of Rupture, psi | 700 | 3,000 |
| Module of Elasticity, 10% psi | 3.5 | 5 |
| Shear Bond Strength, psi | 125 | 650 |
| Water Absorption, % | 5.5 | 0.6 |
| Freeze/Thaw Resistance, no. of cycles/% wt. loss | 700/25 | 1,600/0 |
| Sulfate Attack, no. of days/% expansion | 500/0.5 | — |
| Resistance to Acid, factor of improvement over control | — | 2c |
| Abrasion Resistance, factor of improvement over control | — | 10 |

Polymer concrete also offers the advantage that the resin selected can be tailored for the particular chemical to be contained within the containment vessel. For example, furan resin is useful to contain a wide variety of chemicals such as acetone, battery acid, carbon tetrachloride, gasoline alcohols and gasoline. And epoxy resin is useful to contain detergent compositions.

The degree of cure of the resin-rich surface shall be checked by the Barcol test. The surface should have a Barcol hardness of at least 90% of the resin manufacturer's minimum specified hardness of the cured resin when tested in accordance with materials used.

In another embodiment, the containment vessel may be constructed of prefabricated sidewalls, and bottom. The fabricated walls then can be shipped to the use site where they are assembled. Alternatively, they may also be assembled at a manufacturing site. In either event, the prefabricated sidewalls and bottoms are assembled to form a fluid/air-tight enclosure. The walls may be bonded together utilizing polymer concrete, having compositions similar to the resin utilized to mold the sidewalls and bottom. Thereafter, crevices between jointed pieces can be filled with resin or thixotropic resin paste, leaving a smooth inner and outer surface.

The removable panel preferably rests upon the top of the sidewalls. A gasket may be interposed to assure a fluid/air tight seal. Any suitable configuration for mating the top and the sidewalls may be utilized but in a preferred embodiment it is envisioned that the panel will also be part of the ground surface and will be of sufficient strength to bear the weight of traffic over the containment vessel. This is preferred since it allows easy access to the tank in the event of a leak.

Alternatively, the containment vessel can be positioned such that it can be covered with pavement. This is less desirable since it complicates removal of the panel because the pavement must first be removed.

The containment vessel has been illustrated as a rectangular box shape. Other shapes can be utilized. Also, the panel top has been illustrated as a single piece. It can be formed in more than one removable piece. Preferably, it is a single piece. Also, the containment vessel may be aboveground. In such applications, it is not necessary that the top be removable but in the alternative a side panel can be removable. If the side is removable, that portion of the container wall which is removable is of sufficient dimensions to allow replacement and removal of the storage container. The invention is also particularly suited for the storage of multiple containers of toxic waste within a single containment vessel. The vessel can be adapted for storage of radioactive materials or wastes by lining the interior of the vessel with lead.

Openings to accommodate filling, dispensing and venting lines and other items may be molded into the containment vessel or can be drilled or cut into the containment vessel. Openings 52, 54 and 56 can be fitted with seals similar to seal 27 to ensure a fluid and air-tight enclosure.

Support members 28 can be molded in the sidewalls supporting the storage container. One or more support members can be used. Alternatively, one or more support members are prefabricated and constructed in such dimensions to receive storage container 18 and later bonded to the walls of containment vessel 12.

Storage container 18 is made up of appropriate composition in relation to the substance stored. Storage container 18 being of smaller dimensions than the inside dimension of outer containment vessel 12. The removable wall panel 16 is of sufficient size to allow placement and removal of storage container. without damage or destruction of the storage container.

While the invention is described in terms of the preferred embodiment, modifications thereof will be apparent to those skilled in the art.

What is claimed is:

1. A containment system comprising:

(a) a secondary containment vessel formed by a wall defining a fluid tight enclosure cavity having one or more removable panels which are not permanently joined to said wall and which can be removed without destruction of said removable panels or said wall and replaced without the reconstruction of said wall or removable panel, said panels dimensioned such that removal of said panels allows for the installation removal of a primary storage container within said secondary containment vessel;

(b) one or more primary storage containers mounted within the enclosure cavity of said secondary containment vessel such that a space is provided between substantially all of the interior wall of said vessel and the primary storage containers mounted therein; and (c) leak detector sensor mounted within said secondary containment vessel and outside of said primary storage container and in communication with the exterior of said secondary containment vessel for monitoring leakage from said primary storage container.

2. The apparatus of claim 1 further comprising supporting members extending from the interior walls of said secondary containment vessel for supporting the storage container such that a space is provided between the interior of the bottom of the secondary containment vessel and the bottom of said storage container.

3. A containment system comprising:

(a) a secondary containment vessel formed by a wall defining a fluid tight enclosure cavity having one or more removable panels, which are not permanently joined to said wall and which may be removed and replaced without reconstruction of said wall or said panels, said panels dimensioned such that removal of said panels allow for the installation and removal of a storage container within said secondary containment vessel, said walls defining a plurality of openings to permit communication between the exterior and interior of said secondary containment vessel;

(b) one or more support members connected to the interior walls of said secondary containment vessel for supporting a primary storage container within said secondary containment vessel;

(c) one or more primary storage containers mounted upon said support members within the enclosure cavity of said secondary containment vessel such that a space is provided between the storage containers and the interior walls of said secondary containment vessel;

(d) one or more leak detector sensors removably mounted within said secondary containment vessel and outside of said primary storage containers and in communication with the exterior of said secondary containment vessel for monitoring leakage of said primary storage container;

(e) an inlet conduit passing through an opening in said secondary containment vessel and the interior of at least one of said primary storage containers to permit filling of at least one of the primary storage containers; and (f) an outlet conduit communicating with the interior of said primary storage vessel and passing through an opening in the secondary containment vessel and connected to at least one of said primary storage containers such that fluid may be extracted from the primary storage containers and delivered outside of the secondary containment vessel.

4. The apparatus of claim 3 further comprising a vent conduit communicating with the interior of said primary storage vessel and passing through an opening in said secondary containment vessel to provide venting of said primary containment vessel.

5. The apparatus of claim 3 wherein said secondary containment vessel is constructed of polymer concrete having the formulation of from 78% to 90% by weight of aggregate, from 7 to 19% by weight resin and from 0.3 to 3% by weight catalyst based on weight of total concrete admixture.

6. The apparatus of claim 4 wherein said secondary containment vessel is constructed of polymer concrete having the formulation of from 78% to 90% by weight of aggregate, from 7 to 19% by weight resin and from 0.3 to 3% by weight catalyst based on weight of total concrete admixture.

7. A containment system comprising:

(a) a secondary containment vessel formed of a bottom wall, four sidewalls, and a removable wall panel which is not permanently attached to said sidewalls or bottom wall and which may be removed and replaced without reconstruction of said sidewalls or bottom wall, said removable wall panel dimensioned such to permit the installation and removal of a storage container within said secondary containment vessel, said secondary containment vessel forming a fluid tight enclosure cavity;

(b) one or more primary storage containers mounted within the enclosure cavity of said secondary containment vessel such that a space is provided between the inner walls of said secondary containment vessel and the outer walls of said primary storage container;

(c) said removable panel of said secondary containment vessel defining recesses for the positioning of leak detection equipment and defining a passageway for the placement of leak detector sensors in said secondary containment vessel, and passageways to permit communication of said leak sensing apparatus with the exterior of said secondary containment vessel;

(d) one or more leak sensors extending from said removable wall panel into the interior of said secondary containment vessel and the space between the primary storage container and the secondary containment vessel for monitoring leakage of said primary storage container;

(e) said sensor being in communication with the exterior of said secondary containment vessel.

8. The apparatus of claim 7 wherein said secondary containment vessel is constructed of polymer concrete.

9. The apparatus of claim 7 wherein leak detecting sensors are positioned within about 3 inches of the bottom of the interior of the secondary containment vessel.

* * * * *